US010245622B2

(12) United States Patent
Tibell

(10) Patent No.: US 10,245,622 B2
(45) Date of Patent: Apr. 2, 2019

(54) DEVICE FOR CLEANING A MATERIAL OR STRUCTURE, E.G. A STEEL MATERIAL

(75) Inventor: Rasmus Erik Tibell, Billdal (SE)

(73) Assignee: SILVENT AB, Boras (SE)

( * ) Notice: Subject to any disclaimer, the term of this patent is extended or adjusted under 35 U.S.C. 154(b) by 808 days.

(21) Appl. No.: 14/127,658

(22) PCT Filed: Jun. 12, 2012

(86) PCT No.: PCT/SE2012/050633

§ 371 (c)(1),
(2), (4) Date: Jan. 23, 2014

(87) PCT Pub. No.: WO2013/002704

PCT Pub. Date: Jan. 3, 2013

(65) Prior Publication Data

US 2014/0150829 A1 Jun. 5, 2014

(30) Foreign Application Priority Data

Jun. 28, 2011 (SE) ..... 1150595

(51) Int. Cl.

| | |
|---|---|
| ***B05B 1/20*** | (2006.01) |
| ***B08B 3/02*** | (2006.01) |
| ***B08B 5/02*** | (2006.01) |
| ***B05B 13/02*** | (2006.01) |
| ***B05B 15/60*** | (2018.01) |

(52) U.S. Cl.

CPC ..... *B08B 3/02* (2013.01); *B05B 1/202* (2013.01); *B05B 13/0207* (2013.01); *B08B 3/022* (2013.01); *B08B 5/023* (2013.01); *B05B 15/60* (2018.02)

(58) Field of Classification Search

CPC ..... B08B 3/02; B08B 5/02; B60S 3/04
See application file for complete search history.

(56) References Cited

U.S. PATENT DOCUMENTS 4,133,350 A * 1/1979 Nelson ..... B05B 15/065 138/44
4,245,786 A * 1/1981 Abrahamsen ..... B05B 3/044 239/242
4,455,706 A 6/1984 Volkmann et al.
(Continued)

FOREIGN PATENT DOCUMENTS

CN 2254783 5/1997
CN 2930906 8/2007
(Continued)

OTHER PUBLICATIONS

International Search Report for Appln. No. PCT/SE2012/050633.
(Continued)

*Primary Examiner* — Spencer E Bell
(74) *Attorney, Agent, or Firm* — Pillsbury Winthrop Shaw Pittman, LLP

(57) ABSTRACT

A cleaning device for cleaning an adjacent surface includes at least a first and a second arm joined by an interconnection to form an angle (α) in relation to each other, wherein each arm comprises at least one cleaning member, wherein the interconnection is constructed and arranged so that the arms are torsionally stiff in relation to each other such that a rotation of one of said arms results in a similar rotation of every other arm.

13 Claims, 6 Drawing Sheets

(56) References Cited

U.S. PATENT DOCUMENTS

| | | | | |
|---|---|---|---|---|
| 5,292,074 | A * | 3/1994 | Clark | B05B 13/0278 134/199 |
| 5,398,372 | A | 3/1995 | Kush | |
| 5,507,841 | A * | 4/1996 | Heckman | A47L 5/14 15/301 |
| 5,638,843 | A * | 6/1997 | Strickland | B08B 3/02 134/123 |
| 2004/0040518 | A1* | 3/2004 | Lowe | A01K 13/003 119/652 |
| 2006/0157093 | A1 | 7/2006 | Belanger | |
| 2011/0277792 | A1* | 11/2011 | Turner | B60S 3/00 134/18 |

FOREIGN PATENT DOCUMENTS

| | | |
|---|---|---|
| EP | 0 652 056 | 5/1995 |
| EP | 0 873 800 | 10/1998 |
| EP | 2 233 219 | 9/2010 |
| JP | 53-131261 | 11/1978 |
| JP | 04-350205 | 12/1992 |
| JP | 09-138064 | 5/1997 |
| JP | 10-199836 | 7/1998 |
| JP | 2003-176982 | 6/2003 |
| JP | 2005-177778 | 7/2005 |

OTHER PUBLICATIONS

Japanese Office Action dated Mar. 8, 2016 for Appln. No. 2014-518489.

Japanese Office Action dated Sep. 25, 2015 for Appln. No. 2014-518489.

Chinese Office Action dated Dec. 31, 2014 for Appln. No. 2012800323929.

Extended European Search Report dated May 4, 2015 for Appln. No. 12803620.

Communication pursuant to Article 94(3) EPC European Application No. 12 803 620.9 dated Apr. 11, 2018.

* cited by examiner

DEVICE FOR CLEANING A MATERIAL OR STRUCTURE, E.G. A STEEL MATERIAL

CROSS-REFERENCE TO RELATED APPLICATIONS

This is the U.S. National Stage of PCT/SE2012/050633, filed Jun. 12, 2012, which in turn claims priority to Sweden Patent Application No. 1150595-5, filed Jun. 28, 2011, the entire contents of all applications are incorporated herein by reference in their entireties.

TECHNICAL FIELD

The present invention relates to a cleaning device for performing a cleaning operation, comprising at least a first and a second arm joined by an interconnection to form an angle in relation to each other, wherein each arm comprises at least one cleaning member.

BACKGROUND ART

The need for efficient cleaning of structures or materials arises within many industrial fields such as at steel- and aluminium working plants as well as within pulp-, paper and wood industries. For instance in the manufacture of steel materials where steel is transported on a belt the surface of the steel often needs cleaning to remove residues from earlier steps of the process in the form of particles and/or substances.

A cleaning device generally used for this purpose is disclosed by EP 2233219 A2 (Achenbach Buchhütten), where a V-shaped cleaning device is suspended above a belt and where a plurality of nozzles are used for blowing a gas medium against the belt to remove residues from the surface. Similar devices are disclosed by EP 0652056 and CN 2254783.

A problem with the above devices, however, is the risk for damages to the cleaning device caused by the belt or the steel material itself bumping against the device, dislocating the nozzles or the entire device and possibly damaging its structure.

When using a V-shaped device, the positioning of the device so that a medium sprayed through the nozzles has a suitable angle of incidence against the belt is also complicated. Adjustment of the nozzles can be a very time consuming and laborious task, especially in case of V-shaped cleaning devices where it is even common to adjust every nozzle angle individually before initiating cleaning operation consuming both time and costs.

Similar cleaning devices are also used within a number of other technical fields, such as for instance automated washing of a vehicle or any technical field involving a belt transporter.

There is therefore a need for a more suitable cleaning device to overcome these problems and achieve an optimised cleaning.

DISCLOSURE OF THE INVENTION

The object of the present invention is to eliminate or at least to minimise the problems described above. This is achieved through a cleaning device for cleaning of an adjacent surface, comprising at least a first and a second arm joined by an interconnection to form an angle in relation to each other, wherein each arm comprises at least one cleaning member, wherein said interconnection is arranged so that said arms are torsionally stiff in relation to each other in such a way that a rotation of one of said arms results in a similar rotation of every other arm.

It is understood that "adjacent surface" in many cleaning operations corresponds to "an underlying surface" (i.e. that the cleaning device is positioned above the surface to be cleaned) but that the invention and the method of the invention is not to be limited to such a position.

The herein referred to "interconnection" is also named "connecting link member".

Thanks to the interconnected arms being torsionally stiff a much simpler and more convenient adjustment of the position of the cleaning members as well as their angle of incidence against the object to be cleaned is possible, even with a device being substantially V-shaped.

According to one aspect of the invention said cleaning member comprises a nozzle supplied with a medium, preferably compressed medium, for spraying towards an object to be cleaned. This enables for an efficient cleaning procedure for cleaning an object or the surface of an object by means of applying a highly compressed medium (such as pressurized air, gas or cleaning liquid) onto said object so that residues such as liquid coolant and/or lubricants will be blown off from the surface.

An "object to be cleaned" may for instance refer to a running surface such as a continuously moving strip or metal sheet or web, however it is understood that the object to be cleaned includes also other structures such as any type or moving web/surface, a conveyor belt or a vehicle to be automatically cleaned in a washing station.

In one embodiment each of said first and second arms comprises a plurality of openings along its length, each opening comprising threaded sections for mounting of cleaning member onto the cleaning device. Hereby a very swift and simple way of attaching and/or replacing the cleaning members (e.g. nozzles) is achieved.

According to yet another aspect of the invention said nozzle is arranged to be adjusted in relation to said object to be cleaned by rotation of said at least two arms. This leads to the advantage that all nozzles on the arms will be adjusted simultaneously with respect to their angle of incidence against the object to be cleaned, and no need for individual alignment is therefore needed. It has proven that an efficient angle of incidence is 30° from a vertical line, however this angle may be advantageous to adjust depending on what residues/dirt is to be removed from the object. Thanks to the invention all nozzles can be adjusted simultaneously by means of rotating one of the arms of the device.

According to yet another aspect of the invention said at least two arms are connected to each other via a middle portion, which middle portion preferably comprises at least one cleaning member. According to this embodiment said device is substantially V-shaped with the middle portion forming a middle base. The cleaning member which is positioned on the middle portion will be pointing in a forward direction with respect to the direction of movement of the device. During cleaning operation pressurized medium (such as air or cleaning liquid) is applied onto the underlying surface. In one embodiment the underlying surface is a running surface moving towards the substantially V-shaped cleaning device. The nozzle of the middle portion will exert e.g. an air jet directed forward thereby splitting/dividing e.g. residues and particles on the object to be cleaned in two portions. The nozzles on the angular at least two arms will subsequently blow off the residues in said two portions in a forward sideways direction efficiently removing it from the area underneath the device, e.g. off from the side edges of e.g. a running metal sheet.

According to yet another aspect of the invention said at least two arms and interconnection form an inner profile and said inner profile is encased in an outer profile that is arranged to absorb an impact in order to protect said inner profile. Hereby the inner profile and the nozzles are shielded/protected from possible damage e.g. from a strike by the object to be cleaned that could otherwise demolish the inner profile of the cleaning device.

According to yet another aspect of the invention said outer profile is further equipped with at least one dampening member for absorbing an impact and said dampening member is mounted so as to avoid blocking or hindering the cleaning operation of said cleaning member. Also this feature will contribute to efficiently protecting the inner profile and its components from damages, and further also provide a protection of the material to be cleaned, for instance protecting the sheet from scratching if it would accidentally get in contact with the device during running operation.

According to yet another aspect of the invention said inner structure comprises at least one bearing member per section, preferably at least two bearing members per section, said bearing members being arranged to allow for the inner structure to be rotationally displaceable in relation to the outer structure while the outer structure remains still. This means that if rotating one arm of the inner structure the torsionally stiff interconnection will transfer the rotation to the entire inner structure leading to that all cleaning members on the first and second arm are adjusted simultaneously. At the same time the outer structure will keep the inner structure in the same configuration during such rotation via the bearings, i.e. although rotating the angular inner profile the device will be kept at the same distance from an underlying surface and a displacement in height from e.g. an underlying belt is avoided. This is possible also thanks to the interconnections being bendable and allowing for the bending of the inner structure during a rotational movement inside the outer profile. Hereby a very efficient, quick and easy way of adjusting the angle of the cleaning members on the substantially V-shaped device is accomplished, saving time and costs.

According to yet another aspect of the invention said device is connected to a fastening structure arranged to enable for axial adjustment of the position of the device. Hereby the device can easily be rightfully positioned across a surface to be cleaned before cleaning operation is initiated.

According to yet another aspect of the invention said fastening structure comprises an outer cylinder and an inner cylinder which inner cylinder is displaceably arranged in an axial and a rotary direction within the outer cylinder, said fastening structure further comprising a locking member and said inner cylinder comprising a coupling means, where the locking member and the coupling means are arranged to cooperate with each other for limiting the displacement of the inner cylinder in axial and rotary direction, and wherein the device is connected to said inner cylinder. The locking member is arranged to be able to lock the position of the fastening structure, and thereby also the position of the cleaning device, in an axial and a rotary direction within the limits set by the cooperation between the coupling means and the locking member. The cleaning device is hereby adjustable in relation to an underlying surface so that the cleaning members will affect a portion of the object intended to be cleaned.

According to yet another aspect of the invention said locking member comprises a friction screw and said coupling means comprises a groove with a width and length, wherein said friction screw and said groove are arranged to cooperate for adjusting the inner cylinder and allowing the cleaning device to move in axial and rotary direction respectively. The friction screw provides a security function in a way that if the device is subjected to a strike from the object to be cleaned where the force of such a strike overcomes the force from the friction screw, the friction screw will release the device from the locked position and allowing for the device to be displaced in a direction away from the object to be cleaned, moving from a substantially horizontal to a substantially vertical alignment adopting a protective position. Preferably the locking member will lock the device in such a protective position preventing it from bouncing back onto the object to be cleaned. Such feature will protect the device from damages that might arise as a consequence of impact from irregularities in the material to be cleaned.

According to yet another aspect of the invention said device is made of steel material, preferably stainless steel material, preferably acid resistant stainless steel. This means that the device is applicable also for removing acidic residues from a steel material after pickling procedure.

It is possible to clean both the top and bottom surface of e.g. a sheet material, by means of positioning cleaning devices above and below the moving sheet applying or spraying a compressed medium onto both sides thereof.

The present invention also relates to a method for cleaning a surface, comprising the steps of providing a cleaning device according to the invention, positioning the cleaning device at a distance from the surface to be cleaned so that each of said cleaning members is arranged at the same distance from said surface to be cleaned, adjusting the position of the cleaning members in relation to the surface to be cleaned by rotating at least one of the arms and ejecting a cleaning medium through said cleaning members onto the surface to be cleaned. The design of the device allows for adjusting the position of all the cleaning members (e.g. nozzles) by means of just rotating one of the arms, which allows for quick and easy adjustment and optimising i.e. the angle of incidence against the adjacent surface to be cleaned. In one preferred aspect of the cleaning method the surface to be cleaned is arranged to move in relation to the cleaning device during cleaning operation.

BRIEF DESCRIPTION OF THE DRAWINGS

The invention will now be described in more detail with reference to the appended drawings, wherein.

DETAILED DESCRIPTION OF THE INVENTION

Figure 1:
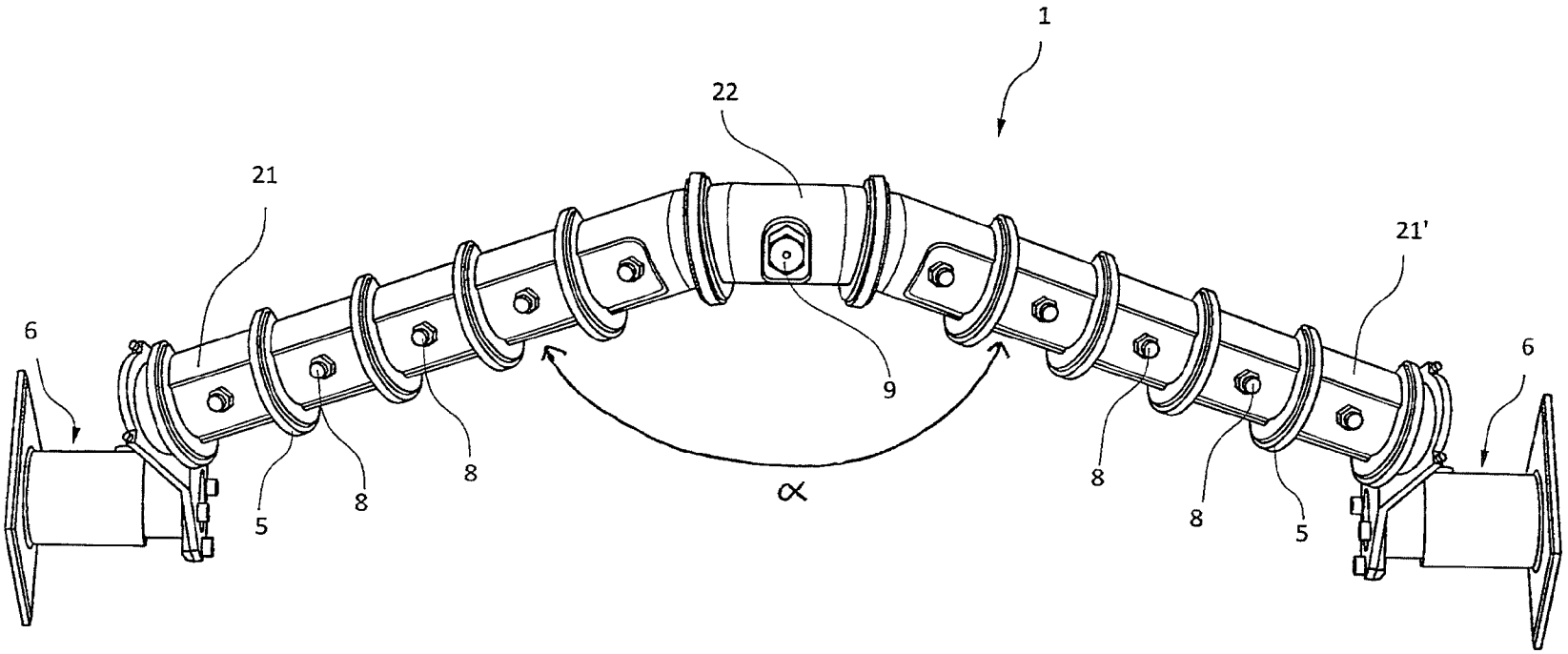
FIG. 1 shows a perspective view of a cleaning device according to a preferred embodiment of the invention.

FIG. 1 shows a preferred embodiment of a cleaning device 1 according to the invention, with an outer profile 2 that has an elongated V-shape so that a first end 21 and second end 21' of the outer profile 2 are at an angle α in relation to each other, with a centre portion 22 forming a base of the V-shape. In this preferred embodiment, the angle α is about 120°. It is to be noted, however, that different angles are suitable for different applications of the invention, and that other shapes, such as a semi-circle or U-shape for instance, are also suitable for the invention with only small modifications. Along and around the outer profile 2, a plurality of dampening members 5 are mounted, and said dampening members 5 preferably at least partly comprise an elastic material such as rubber, suitable for absorbing an impact.

A plurality of cleaning members 8, here in the form of nozzles, are mounted along an inner profile 3 placed inside the outer profile 2 and generally following the same V-shaped as described above. The dampening members 5 are placed to protect the inner profile 3 by absorbing an impact directed towards the cleaning device 1 without risking damage to the inner profile 3 or the cleaning members 8, but at the same time the dampening members 5 are placed to allow the cleaning members 8 to interact freely with their surroundings without risking to block any substance being ejected through the cleaning members 8. In this preferred embodiment, the cleaning members 8 comprise nozzles 8 that are arranged to eject a gas medium.

The first and second ends 21, 21' of the cleaning device 1 are mounted on a fastening structure 6 that serves to secure the cleaning device 1 in relation to its surroundings. The fastening structure 6 can for instance be attached to a larger frame for controlling the cleaning operation, or to walls of a cleaning chamber, among others.

Figures 2A, 2B, 3A, 3B, 3C:
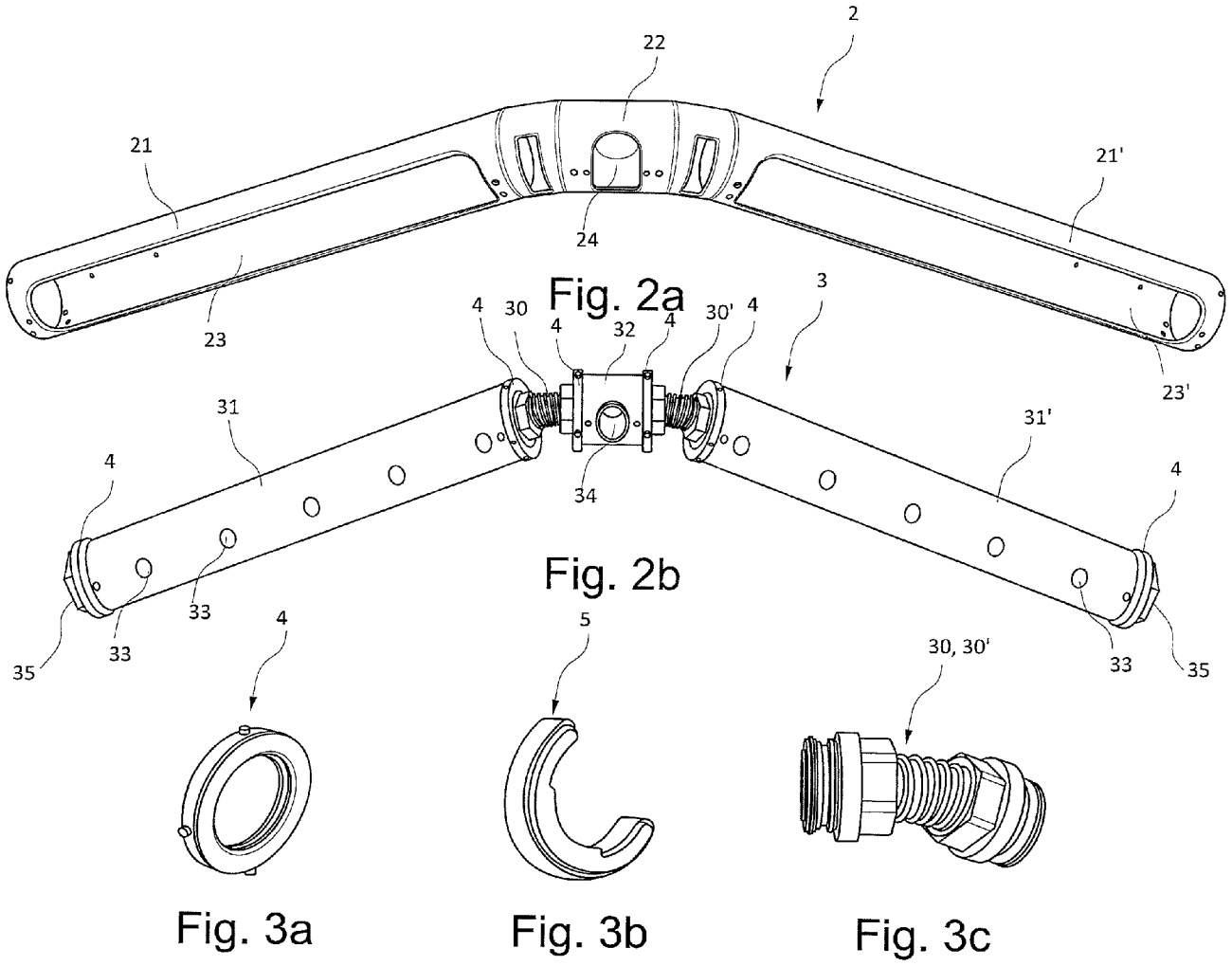
FIG. 2*a* shows a perspective view of an outer profile of the cleaning device.
FIG. 2*b* shows a perspective view of an inner profile of the cleaning device.
FIG. 3*a* shows a perspective view of bearings for connecting the outer profile of FIG. 2*a* with the inner profile of FIG. 2*b;*
FIG. 3*b* shows a perspective view of a dampening member for attaching onto the outer profile.
FIG. 3*c* shows a perspective view of a connecting link member for interconnecting two sections of the inner profile of FIG. 2*b;*

In FIG. 2*a*, the outer profile 2 is shown, with a first and second elongated opening 23, 23', respectively, extending along each of the legs of the V-shape from the centre portion 22 towards each of the first and second ends 21, 21'. The centre portion 22 also comprises an opening in the form of a central opening 24. The location of these openings 23, 23', 24 is adapted to the shape of the inner profile 3 so that the inner profile 3 can be completely surrounded by the outer profile 2 while at the same time allowing the cleaning members 8 to be in contact with surroundings of the outer profile 2 and have a free range there. It is to be noted that the outer profile 2 is hollow and that end openings are provided at the first and second end 21, 21' as well as in the centre portion 22. Through these end openings, the inner profile 3 can be inserted during mounting, as will be described further below, and connections for a pressurised medium, such as a gas or a fluid, can be inserted into the inner profile 3 in order to supply said medium to the cleaning members 8. Separate connection of air to each of said three inlets (i.e. said openings at the first and second end 21, 21' and at the centre portion 22 respectively) allows for varying the intensity of the ejected pressurised medium between the different cleaning members 8, 9. For instance it is possible to introduce a compressed medium though the central nozzle 9 with higher pressure compared to the distal nozzles 8 and vice versa.

FIG. 2*b* shows the inner profile 3 that is to be located inside the outer profile 2, with a first arm 31 and a second arm 31' that are connected to a middle portion 32 by connecting link members 30, 30', respectively. The first and second arm 31, 31' thus in this embodiment form two sections that are interconnected through the connecting link members 30, 30', but in other embodiments it may be more suitable with a larger number of sections that are interconnected to form another shape, such as a semi-circle or a U-shape, for instance.

A plurality of openings 33 are located along the first and second arm 31, 31' and in this embodiment comprise threaded sections where the nozzles 8 can be securely screwed into position to form the cleaning members 8. The middle portion 32 comprises a centre opening 34 where a centre nozzle 9 can similarly be mounted.

Bearings 4 are located at each end of the first and second arm 31, 31' and at each end of the middle portion 32 and when the inner profile 3 is mounted inside the outer profile 2 these bearings allow the inner profile 3 to rotate while allowing the outer profile 2 to keep still. The connecting link members 30, 30' are arranged to allow a bending but not a twisting movement, so that an angle formed between the first arm 31 and the middle portion 32 can be altered by bending the connecting link member 30 but that a rotation of the first arm 31 will result in similar rotation of the middle portion 32 also. This means that the first and second arm 31, 31' are torsionally stiff in relation to each other in such a way that a rotation of one of the arms 31, 31' results in a similar rotation of every other section connected to the section being rotated. The second arm 31' is arranged in similar fashion.

At the ends of the first and second arm 31, 31' away from the middle portion 32, adjustment nipples 35 are mounted for allowing a rotationary adjustment of the first and second arm 31, 31'.

FIG. 3*a* shows one of the bearings 4 that are mounted around the inner profile 3 but inside the outer profile 2, and FIG. 3*b* shows one of the dampening members 5 that can be mounted around the outer profile 2 and serves to absorb an impact against the cleaning device 1. The dampening members 5 can preferably be mounted by clamping around a circumference of the outer profile 2 so that they fit snugly but without causing indentations into the outer profile 2. In this embodiment, the dampening members 5 comprise a coating portion of a shock absorbing material such as rubber of a similar elastic material, but the dampening members 5 can alternatively comprise a softer metal material, a composite material, etc.

In FIG. 3*c*, a connecting link member 30 or 30' is shown. It comprises two ends with fastening portions suitable for fastening tightly onto the first or second arm 31, 31' and onto the middle portion 32, and between said two ends a bendable section is provided that allows the interconnecting link member 30, 30' to be bent to form a desired angle between the two ends.

Figure 4:
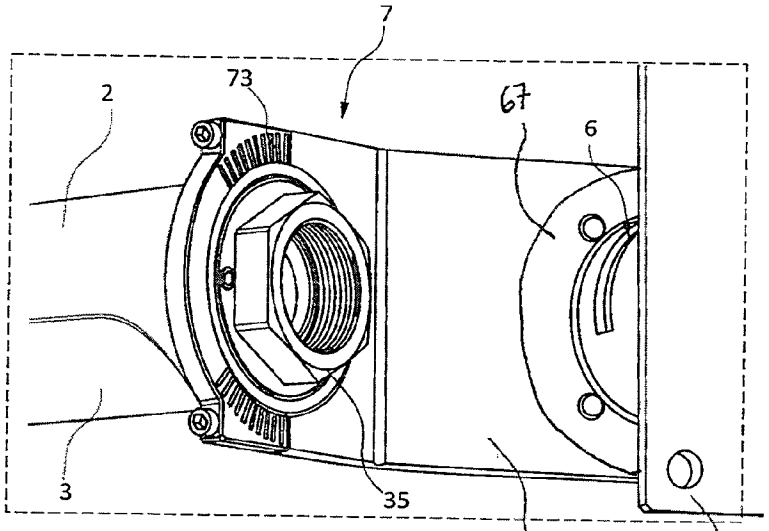
FIG. 4 shows a perspective view of an adjustment connection for connecting the outer and inner profile to a holding structure.

FIG. 4 shows the fastening structure 6 onto which the inner and outer profile 3, 2 of the cleaning device 1 is mounted by means of an adjustment connection 7. It can now be seen that the adjustment nipple 35 extends through the adjustment connection 7 and can be manipulated to allow the inner profile 3 to rotate in relation to the outer profile 2. The adjustment connection 7 further comprises an adjustment plate 70 which at the one end is connected to the fastening structure 6 and at the other end to the inner and outer profile 3, 2 of the cleaning device 1.

Figure 5B:
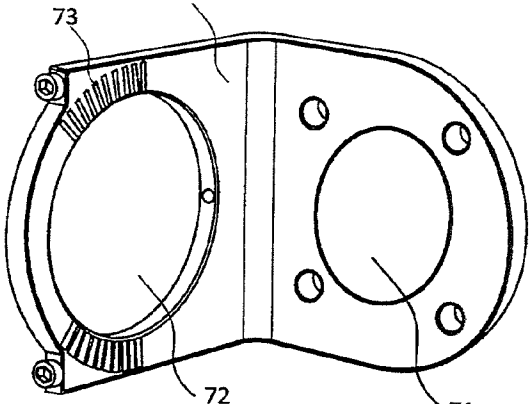
FIG. 5*b* shows a second version of the adjustment connection of FIG. 4.
Figure 5A:
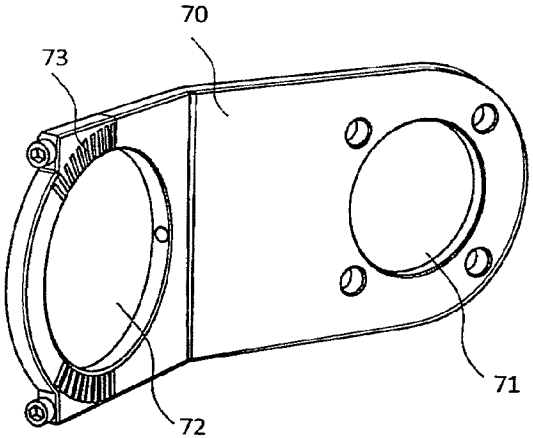
FIG. 5*a* shows a first version of the adjustment connection of FIG. 4.

FIG. 5*a* and FIG. 5*b* show a first and second version of the adjustment connection 7, with an adjustment plate 70, 70' and adjustment openings 71, 72 for fastening the adjustment connection 7 onto the fastening structure 6 and the outer profile 2, respectively. The adjustment opening 72 arranged for connection onto the outer profile 2 comprises a grading 73, as an aid in determining how much to rotate the inner profile 3 by means of the adjustment nipple 35 to achieve a desired result. The main difference between the first and second versions of the adjustment connection 7 shown in FIGS. 5*a* and 5*b* is the shape of the adjustment plate 70, 70', that can be of different lengths and shaped differently to form a smaller or larger angle between the adjustment openings 71, 72 depending on what is suitable for the application of the cleaning device 1 according to the invention.

Figure 6B:
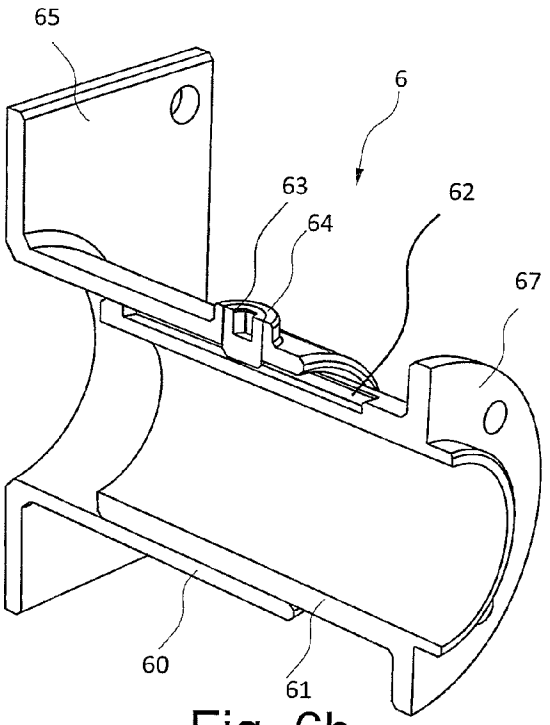
FIG. 6*b* shows a cross-sectional perspective view of the fastening structure of FIG. 6*a;*
Figure 6C:
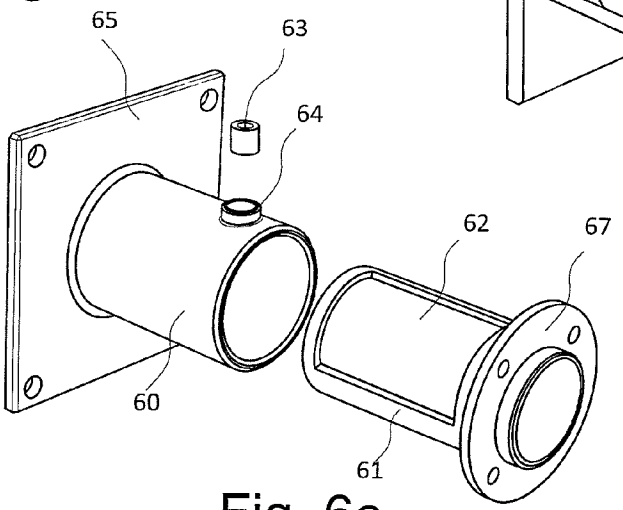
FIG. 6*c* shows an exploded view of the fastening structure of FIG. 6*a;*
Figure 6A:
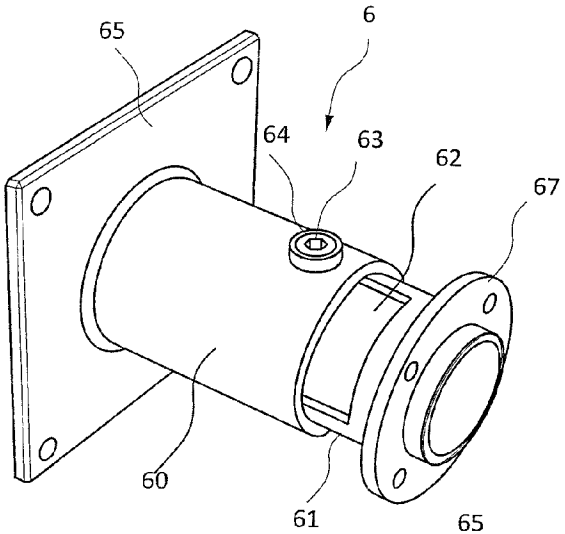
FIG. 6*a* shows a perspective view of a fastening structure for the cleaning device.

FIGS. 6*a*, 6*b* and 6*c* show the fastening structure 6 that serves to secure the cleaning device 1 with the outer and inner profile 2, 3 to another structure such as a wall or frame. The fastening structure 6 comprises an outer cylinder 60 and a fastening plate 65 for fastening onto said other structure. An inner cylinder 61 is placed inside said outer cylinder 60 and can slide in relation to said outer cylinder 60 in an axial direction as well as a rotary direction. The outer cylinder 60 comprises an opening 64 for a locking member 63, in this embodiment a friction screw 63 that can exert a frictional force on the inner cylinder 61 so that a relative movement of the cylinders 60, 61 can be prevented. The inner cylinder 61 further comprises a groove 62 with a suitable width and length for adjusting the inner cylinder 61 and allowing the cleaning device 1 to move to a protective position, as will be described further below.

The inner cylinder 61 ends in a flange 67 onto which the adjustment opening 71 for the adjustment connection 7 can be mounted. The mounting can be effected by the use of screws or any other suitable connection means, and the same is true for the mounting of the fastening structure 6 onto a frame or a wall.

Figure 7A:
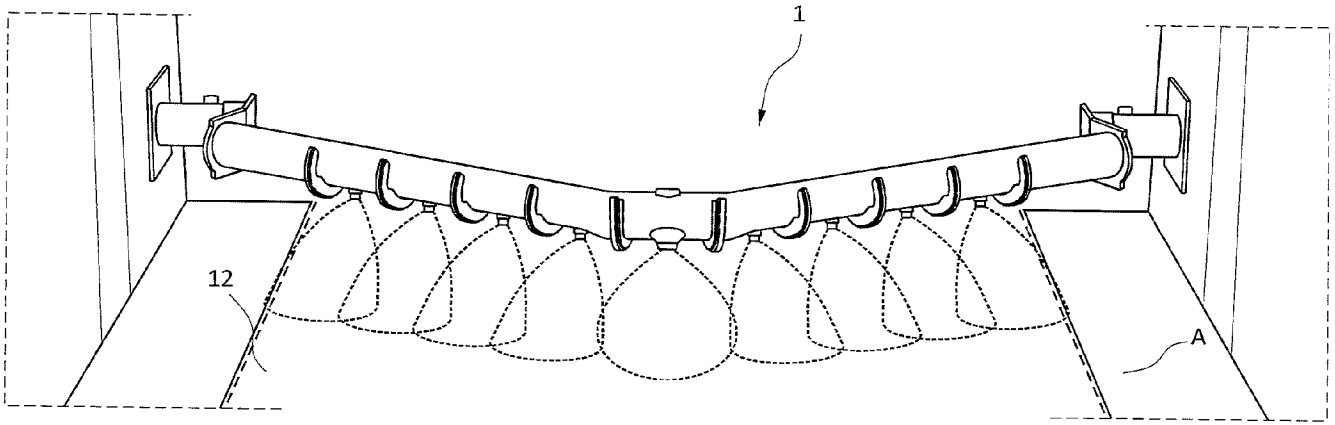
FIG. 7*a* shows a perspective view of the cleaning device mounted on a holding structure and located above a conveyor belt moving in a direction A.

In FIG. 7*a*, the cleaning device 1 can be seen in its mounted condition, arranged adjacent to a surface to be cleaned which herein is in the form of a conveyor belt 12. The device 1 is attached to side walls by means of the fastening structure 6 and the adjustment connection 7. In FIG. 7*a* the cleaning device 1 is suspended horizontally and above an underlying conveyor belt 12 on which a material or structure to be cleaned is transported. The skilled person understands that the cleaning device 1 may be positioned in other ways than horizontally depending on the alignment of the surface to be cleaned. For instance if the surface to be cleaned would be a vehicle, the cleaning device 1 would rather be moveable across the body of the vehicle instead of fixated as in FIG. 7*a*.

In FIG. 7*a* the surface to be cleaned is a steel material which is transported in a direction A on said conveyor belt 12. When suspended thus, a cleaning medium such as pressurised air can be ejected through the cleaning members 8 and interact with a surface of the steel material, and through this interaction, said surface can be cleaned. In another preferred embodiment, the surface to be cleaned is a running web in a pulp and paper process. In yet another embodiment, the surface to be cleaned is a plurality of objects being transported on the conveyor belt 12. Due to the presence of these objects, the cleaning device 1 will need to be mounted at a greater distance from the conveyor belt 12 than in the embodiments with a steel material or a running web, due to the increased risk of the objects colliding with the cleaning device 1. In still another embodiment, the surface to be cleaned is the surface of a rotating transfer roll used in a pulp and paper process. Now, the cleaning device 1 may need to be mounted in such a way that its placement with regard to the transfer roll is not directly above, but rather at a horizontal distance from a centre of the roll or even at a vertical distance beneath said roll.

It is to be noted, however, that the process described herein for cleaning the objects or the surface of a transfer roll, running web or steel material on the conveyor belt 12 is similar regardless of the specific application of the invention according to any of the embodiments mentioned above, or indeed any other suitable application for the invention as specified by the claims. Minor adjustments can of course be required, such as selecting a cleaning fluid or cleaning gas to be ejected through the nozzles 8, 9 and the force with which it is ejected. For instance, the cleaning of a running web will require less force than the cleaning of a stainless steel material and the cleaning agent most suited for performing the cleaning operation will differ.

When cleaning a surface, a number of factors contribute to an efficiency of the cleaning operation. One such factor is the pressure with which the medium is sprayed through the cleaning members 8 and another the angle of incidence of the medium against the steel material. A cleaning device 1 that is V-shaped or similarly bent can enable a more efficient cleaning operation where substances present on the surface of the steel material can be pushed to the side of the steel material and thus be removed from the surface altogether.

Thanks to the rotatability of the inner profile 3, the cleaning members 8 can be adjusted so that an angle of incidence against the surface to be cleaned is altered without removing the cleaning device 1 from its horizontal position. This is a significant advantage of the invention, since it allows for an optimisation of the operation of the cleaning device 1, where the angle of incidence can be adjusted easily and allow a user to achieve the best possible cleaning result depending on the material to be cleaned and the substances or particles that are to be removed. If the removal is difficult, an angle of incidence that gives a higher pressure against the surface may be the most suitable, while more easily removable substances or particles could perhaps be removed in a more energy efficient manner by aiming the nozzles 8 at a larger angle against a vertical line.

Figure 7B:
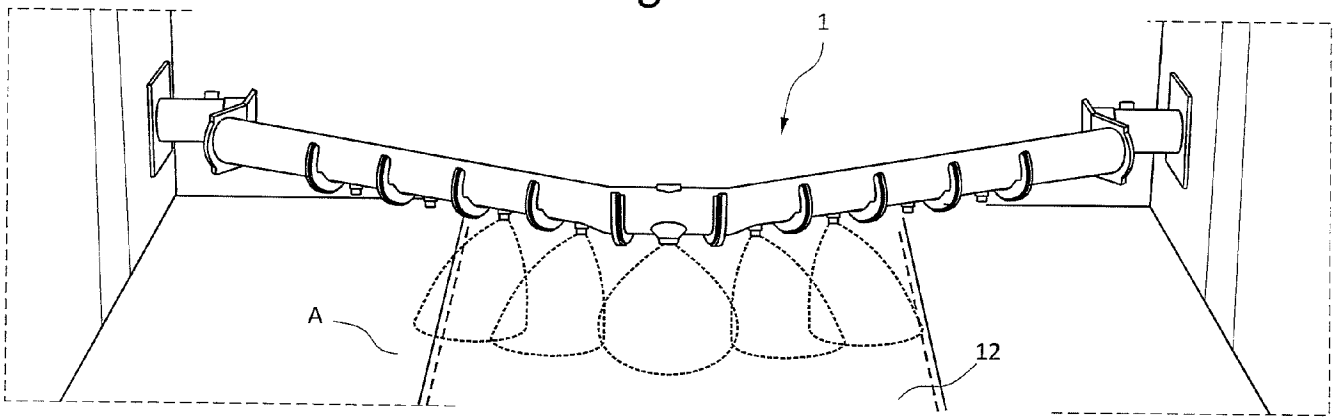
FIG. 7*b* shows a perspective view of the mounted cleaning device of FIG. 7*a* with a narrower conveyor belt moving in a direction A.

FIG. 7*b* shows the mounted cleaning device 1 suspended across the width of a conveyor belt 12 that is more narrow. In this application, the position of the cleaning device 1 can be adjusted to achieve an optimised cleaning, and some of the cleaning members 8 can be deactivated to concentrate the cleaning operation to the cleaning devices 8 that are located directly above the conveyor belt 12.

Figure 8:
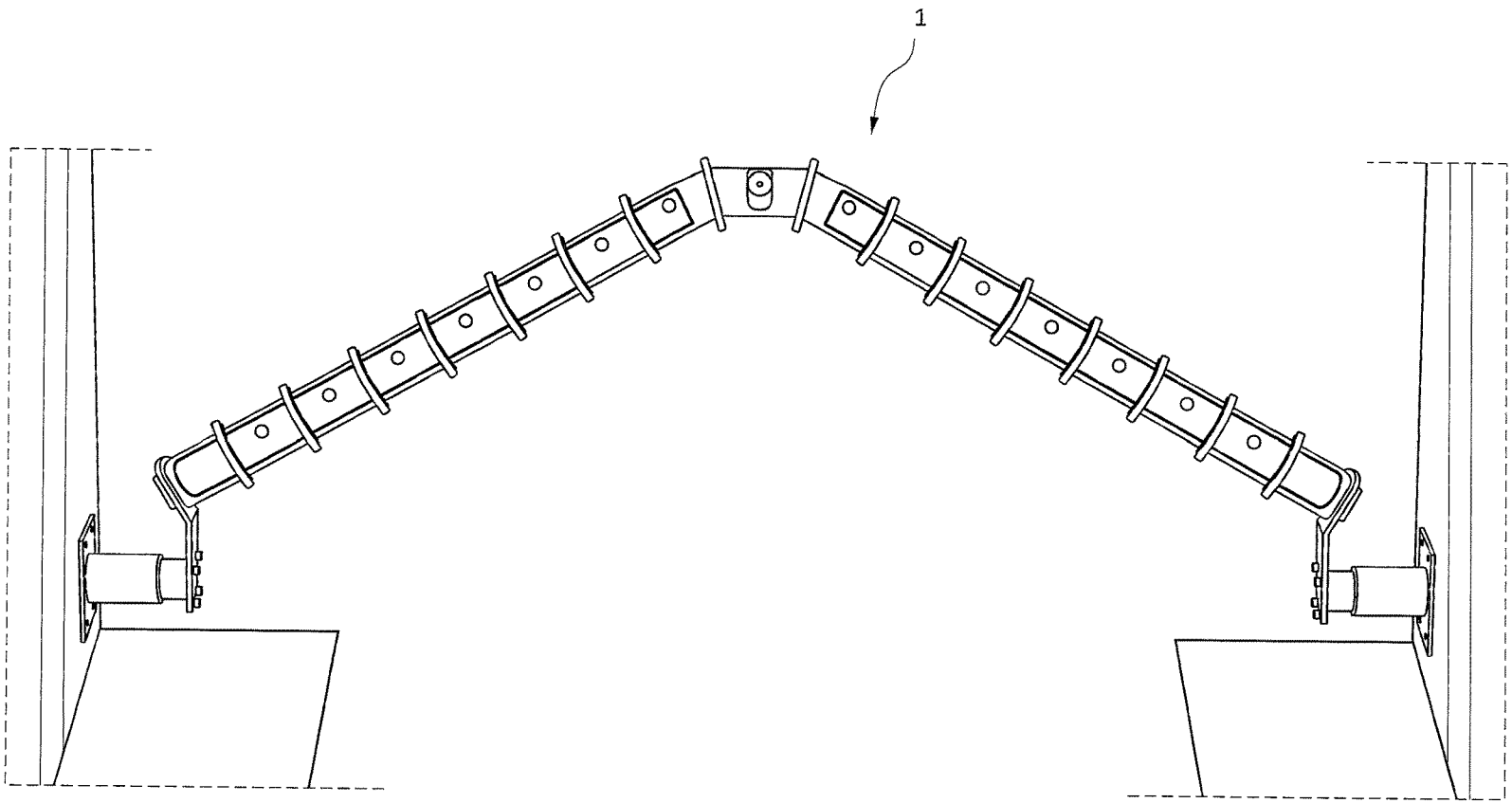
FIG. 8 shows the mounted cleaning device of FIG. 7*a*-7*b* in a protective position.

A general problem within the area of cleaning moving materials or objects is the risk of impacts against the cleaning device 1 if the material or object should wobble in its movements or if it is uneven with areas extending upwards to the direct vicinity of the cleaning device 1. Through such an impact, the cleaning members 8 can be dislocated to severely impair the cleaning operation, or the cleaning device 1 itself can be damaged in such a way that its operation is hindered or otherwise impaired. For this purpose, the dampening members 5 are provided, as described above, but as an additional protective measure, the fastening structure 6 can be rotated so that the cleaning device 1 reaches a vertical position shown by FIG. 8. This rotation is effected when an impact causes a force larger than the frictional force of the frictional screw against the inner cylinder 61 to act on the cleaning device 1. The impact will cause the frictional screw 63 to release the inner cylinder 61, thus allowing the inner cylinder 61 to rotate in the outer cylinder 60 until the frictional screw 63 hits an end of the groove 62 on the inner cylinder 61. The groove 62 is adapted to allow for a movement of 90° from a position where the frictional screw 63 locks the inner cylinder 61 into place to a position where the frictional screw 63 reaches the end of the groove 62 and thereby prevents a further rotation of the inner cylinder 61. In this position, the cleaning device 1 has been turned approximately 90° to a vertical direction and has reached a protective position where the risk for further impacts from the materials or objects being transported on the conveyor belt 12 is very low. Thanks to this repositioning of the cleaning device 1, the cleaning device 1 can be used for longer stretches of time without requiring reparations and its operation can be maintained at a high quality. It is advantageous if the friction exerted by the friction screw 63 onto the inner cylinder 61 is adapted to match the force of the largest impact that the cleaning device 1 can sustain without risking injury, so that the friction screw 63 will release the cleaning device 1 into the protective position 1 before the risk for injury arises. It is, however, also advantageous to keep the cleaning device 1 in an operational position if only smaller impacts are to be expected, since these smaller impacts can be absorbed by the dampening members 5 and do not risk causing damage to the cleaning device 1 itself.

The operation of the cleaning device will now be described in more detail with reference to the Figures.

When mounting the cleaning device 1, the inner profile 3 is placed into the outer profile 2 by means of the bearings 4 that serve to allow the inner profile 3 to rotate freely in relation to the outer profile 2, while keeping the latter stationary. Thanks to the connecting link members 30, 30' being bendable while at the same time preventing a rotation of the first arm 31 in relation to the second 31' and vice versa, the inner profile 3 can rotate while at the same time adapting to the shape of the outer profile 2 so that the V-shape in this embodiment is preserved. After the dampening members 5 have been attached and the outer and inner profile 2, 3 been mounted onto the fastening structure 6 by means of the adjustment connection 7, and after the cleaning members 8 have been mounted into the openings for the nozzles and the central nozzle 33, 34, the cleaning device is ready for use.

By rotating the adjustment nipple 35, the angle between the nozzles and a conveyor belt 12 can be adjusted to optimise the performance of the cleaning operation. This is achieved in this embodiment by manually turning the adjustment nipple 35 and checking on the grading 73 to determine which angle has been selected, but can in some embodiments also be performed automatically by control means that serve to control and adapt the operation of the cleaning device according to instructions provided by an operator or a pre-programmed software product. Multiple cleaning devices can of course be provided in conjuncture with a conveyor belt 12, one after the other, so that multiple cleaning operations can be performed on the same object or area of a material being transported. In that case, the adjustment nipples 35 of multiple cleaning devices can be adjusted to a similar position, to allow for identical cleaning operations, or to different positions so that the effect of the cleaning differs.

A medium for cleaning is supplied to the cleaning device 1 by connecting a supply tube (not shown) to either end of the inner profile 3 and/or to the middle portion 32 of the inner profile. For this purpose, the outer profile 2 comprises openings 23, 23' at either end of the profile 2 and also a central opening 24 that corresponds to the middle portion 32 of the inner profile 3. Through any or all of these openings, the medium can be supplied, preferably in the form of a gas or a liquid for cleaning. In this preferred embodiment, pressurised air is used and is sprayed through the nozzles 8, 9 for cleaning the material on the conveyor belt 12, but other media such as oxygen, cleaning fluids or water can also be used depending on the application of the cleaning device 1. The cleaning device 1 can be manufactured by materials that are resistant to influences from the materials and substances that may be encountered during operation and thus avoid corrosion and similar detrimental processes. When cleaning a steel material, for instance, it is advantageous to use an acid resistant steel material for the cleaning device 1. When cleaning a running web, it may be more advantageous to use water as a cleaning fluid, and the cleaning device 1 can be made from stainless steel or another suitable material.

The opening or openings not used for supply tubes supplying a medium are preferably sealed to prevent a leakage and to maintain a desired pressure inside the inner profile 3. If desired, the openings can be used for supplying different media within the same inner profile 3, and in this case it is of course advantageous to seal off parts of the inner profile 3 to prevent the media from mixing. For instance, one medium can be sprayed through the central nozzle 9 and another through the other nozzles 8. The pressure under which the medium or media is or are sprayed from the cleaning members 8, 9 can of course also be varied depending on the application.

The cleaning device 1 is then used for cleaning a material or object being passed below the horizontally suspended cleaning device 1. If desired, the cleaning device 1 can be adjusted sideways by operating the inner cylinders 61 of the fastening structure 60 to push the entire cleaning device to one side. This adjustment can also be made either manually by an operator or in an automated manner by a control system depending on what is suitable for a particular application.

In some embodiments, the cleaning device 1 can be suspended below a material to be cleaned and be arranged to spray upwards, while other applications may require a combination of cleaning devices suspended in different positions.

During operation of the cleaning device 1, the risk for damages arises due to material or objects passing below the cleaning device 1 and bumping or scraping against the cleaning device 1. If only smaller impacts are performed against the cleaning device 1, the force can be absorbed by the dampening members 5 or even by the outer profile 2 itself in order to protect the more vulnerable cleaning members 8, 9 and inner profile 3 where damages could result in a severely impaired cleaning operation. Larger impacts, however, could involve larger forces than can easily be handled by the dampening members 5, and therefore the protective position described above can be assumed. This is effected through any such larger impact against the cleaning device 1 causing the friction screw 63 releasing the inner cylinder 61 from the outer cylinder 60. The inner cylinder 61 can then rotate freely until the friction screw 63 reaches the end of the groove 62 and prevents further movements, and by the force of the impact the cleaning member 1 is pushed upwards. When further movement is no longer possible, the friction screw 63 again locks the inner cylinder 61 into position in relation to the outer cylinder 60 and the cleaning device has assumed the protective position shown by FIG. 1 with the inner and outer profiles 3, 2 being positioned in a vertical direction. In this position, the risk for damages due to impacts from materials or objects being transported along the conveyor belt 12 is very small, since the distance between the conveyor belt 12 and the cleaning device 1 has been significantly increased. In order to reposition the cleaning device 1 in the horizontally suspended position, the inner and outer profiles 3, 2 can be manually adjusted or be controlled by a control system as is deemed suitable. It is, however, advantageous that the mechanism provided, using the rotation of the inner cylinder 61 in relation to the outer cylinder 60 by way of the friction screw 63, is activated without the need for supply of electrical power or the operation of a control system, since this enables an operation of the mechanism even in a situation of power failure or under other emergency conditions.

The invention is not to be seen as limited by the preferred embodiments described above, but can be varied within the scope of the appended claims. For instance, the cleaning members can be slits or openings rather than nozzles, or nozzles can be provided mounted differently. The conveyor belt disclosed for transporting materials or objects can be replaced by a process transporting steel in an endless belt or by a paper or fibre web in a paper machine, for instance. In some applications, it may also be advantageous to allow the cleaning device to move along a material, object or web that is to be cleaned, while keeping the latter stationary.

Thus the skilled person understands that the cleaning device according to the invention is not to be limited to a certain industrial field, but that it may be used for many different cleaning operations, cleaning many different types of materials whether the object to be cleaned is a running web, conveyor or belt or if the object to be cleaned is a rotating transfer roll for use in paper industry.

The invention claimed is:

1. Cleaning device for cleaning of an adjacent surface, comprising:

a cleaning unit, the cleaning unit comprising:

a leading central portion configured and arranged to be relatively moved past the adjacent surface in a travel direction and to supply a pressurized medium to the adjacent surface to clean it, the leading central portion having two opposite ends;

a first arm, attached by a bendable connection to and in fluid communication with the leading central portion and configured and arranged to be relatively moved past the adjacent surface trailing the leading central portion in the travel direction, and to supply the pressurized medium to the adjacent surface to clean it; and a second arm attached by a bendable connection to and in fluid communication with the leading central portion and configured and arranged to be relatively moved past the adjacent surface trailing the leading central portion in the travel direction, and to supply the pressurized medium to the adjacent surface to clean it;

wherein the first and second arm are joined to the opposite ends of the leading central portion to form an angle ($\alpha$) in relation to each other, wherein each arm comprises at least one cleaning member, wherein said leading central portion is arranged so that said arms are torsionally stiff in relation to each other such that a rotation of one of said arms results in a similar rotation of every other arm, and wherein said at least two arms and the leading central portion are encased in an outer profile that is arranged to absorb an impact to protect said inner profile, the outer profile having a central portion corresponding to the leading central portion and first and second end portions corresponding respectively to the first and second arms, each end portion being joined to the central portion of the outer profile to form the angle ($\alpha$) in relation to each other.

2. Cleaning device according to claim 1, wherein each of said first and second arm comprises a plurality of openings, each opening comprising threaded sections for mounting of the cleaning member onto the cleaning device.

3. Cleaning device according to claim 1, wherein said cleaning member comprises a nozzle that is supplied with the presssurized medium for spraying towards the adjacent surface.

4. Cleaning device according to claim 3, wherein each said nozzle is arranged to be adjusted in relation to said surface by rotation of said at least two arms.

5. Cleaning device according to claim 1, wherein said inner profile comprises tubular members, and said outer profile comprises tubular members having respective diameters larger than diameters of the inner profile, and wherein said outer profile comprises openings corresponding to nozzles of the inner profile to allow passage of the pressurized medium therethrough.

6. Cleaning device according to claim 5, wherein said outer profile is further equipped with at least one dampening member for absorbing an impact and said dampening member is mounted so as to avoid blocking or hindering an operation of said cleaning member.

7. Cleaning device according to claim 5, wherein said inner profile comprises at least one bearing member per arm, said bearing members being arranged to allow for the inner profile to be rotationally displaceable in relation to the outer profile.

8. Cleaning device according to claim 1, wherein said device is connected to a fastening structure arranged to enable for axial adjustment of the position of the device.

9. Cleaning device according to claim 8, wherein said fastening structure comprises an outer cylinder and an inner cylinder which inner cylinder is displaceably arranged in an axial and a rotary direction within the outer cylinder, said fastening structure further comprising a locking member and said inner cylinder comprising a coupling means, where the locking member and the coupling means are arranged to cooperate with each other for limiting the displacement of the inner cylinder in axial and rotary direction, and wherein the device is connected to said inner cylinder.

10. Cleaning device according to claim 9, wherein said locking member comprises a friction screw and said coupling means comprises a groove with a width and length, wherein said friction screw and said groove are arranged to cooperate for adjusting the inner cylinder and allowing the cleaning device to move in axial and rotary directions respectively.

11. Cleaning device according to claim 1, wherein said device is made of steel material, preferably stainless steel material, preferably acid resistant stainless steel.

12. Cleaning device according to claim 1, wherein the leading central portion includes at least one spray nozzle, configured and arranged to supply the pressurized medium to the adjacent surface to clean it.

13. Cleaning device according to claim 1, wherein the first arm and the second arm are each connected, at respective ends distal from the leading central portion, to respective fastening structures that secure the cleaning device to a frame.

* * * * *